US008985018B2

(12) United States Patent
Patterson

(10) Patent No.: US 8,985,018 B2
(45) Date of Patent: Mar. 24, 2015

(54) STACKABLE CONTAINER SYSTEMS AND METHODS

(71) Applicant: Clearsnap Holding, Inc., Burlington, WA (US)

(72) Inventor: Mark G. Patterson, Bellingham, WA (US)

(73) Assignee: Clearsnap Holding, Inc., Burlington, WA (US)

( * ) Notice: Subject to any disclaimer, the term of this patent is extended or adjusted under 35 U.S.C. 154(b) by 17 days.

(21) Appl. No.: 13/764,616

(22) Filed: Feb. 11, 2013

(65) Prior Publication Data

US 2013/0145942 A1 Jun. 13, 2013

Related U.S. Application Data

(63) Continuation of application No. 13/252,906, filed on Oct. 4, 2011, now abandoned, which is a continuation of application No. 12/229,995, filed on Aug. 27, 2008, now Pat. No. 8,028,622.

(60) Provisional application No. 61/069,209, filed on Mar. 12, 2008.

(51) Int. Cl.

| | |
|---|---|
| ***B41K 1/38*** | (2006.01) |
| ***B41K 1/54*** | (2006.01) |
| ***B41K 1/58*** | (2006.01) |

(52) U.S. Cl.

CPC .... *B41K 1/54* (2013.01); *B41K 1/58* (2013.01)
USPC ..... 101/333; 101/405; 206/503; 220/4.27

(58) Field of Classification Search

CPC ..... B41K 1/54; B41K 1/58; B65D 21/0209; B65D 21/0228
USPC ..... 101/103, 109, 327, 333, 405, 406; 206/503, 508, 509, 581; 220/4.27, 220/4.26; D18/15
IPC ..... B41K 1/38,1/42, 1/54
See application file for complete search history.

(56) References Cited

U.S. PATENT DOCUMENTS 1,334,540 A * 3/1920 Jones ..... 101/333
D70,131 S 5/1926 Leviten et al.

(Continued)

OTHER PUBLICATIONS

Clearsnap Holding, Inc., Prior art drawings for "Stack-A-Pad" pad design, 1992, 3 pages.

(Continued)

*Primary Examiner* — Leslie J Evanisko
(74) *Attorney, Agent, or Firm* — Michael R. Schacht; Schacht Law Office, Inc.

(57) ABSTRACT

A container system for containing a plurality of ink pads including a cover and a plurality of bases. The cover defines a cover mounting portion. Each base defines a support surface, a first base mounting portion, and a second base mounting portion. Each of the support surfaces is adapted to support at least one of the ink pads. The cover mounting portion is capable of engaging any one of the first base mounting portions to detachably attach the cover to the plurality of bases. The first base mounting portions are capable of engaging the second base mounting portions to detachably attach at least one of the bases to at least another of the bases. The container system operates in a stack mode and in a single mode. In the stack mode, the cover is detachably attached to one of the plurality of bases, and the one of the plurality of bases to which the cover is detachably attached is detachably attached to another of the plurality of bases. In the single mode, the cover is detachably attached to one of the plurality of bases and the plurality of bases are detached from each other.

10 Claims, 7 Drawing Sheets

(56) References Cited

U.S. PATENT DOCUMENTS

| | | | | | |
|---|---|---|---|---|---|
| 2,117,470 | A | | 5/1938 | Zareko | |
| 2,514,573 | A | * | 7/1950 | Harrison | 220/4.24 |
| 2,584,908 | A | | 2/1952 | Oblinger | |
| 2,891,472 | A | | 6/1959 | Holzer | |
| 2,938,292 | A | | 5/1960 | Jaskowsky et al. | |
| 2,986,300 | A | | 5/1961 | Parrish | |
| 2,999,611 | A | | 9/1961 | Paulson | |
| 3,020,838 | A | | 2/1962 | Prost | |
| 3,090,304 | A | | 5/1963 | Sulkie | |
| 3,145,870 | A | | 8/1964 | Lockwood | |
| 3,346,137 | A | | 10/1967 | Ricci | |
| 4,294,371 | A | | 10/1981 | Davis | |
| 4,545,140 | A | | 10/1985 | Winston | |
| 4,817,526 | A | | 4/1989 | Winston | |
| 5,313,885 | A | | 5/1994 | Winston | |
| D353,392 | S | | 12/1994 | Winston | |
| 5,431,098 | A | | 7/1995 | Winston | |
| D364,183 | S | | 11/1995 | Winston | |
| D364,417 | S | | 11/1995 | Winston | |
| D367,291 | S | | 2/1996 | Winston | |
| 5,505,130 | A | | 4/1996 | Winston | |
| 5,535,908 | A | * | 7/1996 | Sheu | 220/4.27 |
| D372,933 | S | | 8/1996 | Winston | |
| D375,516 | S | | 11/1996 | Winston | |
| 5,636,569 | A | | 6/1997 | Winston | |
| 5,671,856 | A | * | 9/1997 | Lisch | 220/4.27 |
| D386,200 | S | | 11/1997 | Winston | |
| D400,567 | S | | 11/1998 | Yasoshima | |
| 5,870,953 | A | | 2/1999 | Winston | |
| 5,909,709 | A | * | 6/1999 | An et al. | 101/405 |
| D419,180 | S | | 1/2000 | Yasoshima | |
| 6,244,180 | B1 | | 6/2001 | Winston | |
| 6,615,719 | B1 | | 9/2003 | Winston | |
| 6,659,007 | B1 | | 12/2003 | Winston | |
| D517,592 | S | | 3/2006 | Salis | |
| 2002/0020634 | A1 | * | 2/2002 | Fortune | 206/5.1 |
| 2006/0065142 | A1 | | 3/2006 | Petersen | |
| 2008/0035646 | A1 | * | 2/2008 | Smith | 220/526 |
| 2012/0187120 | A1 | * | 7/2012 | Winton | 220/200 |

OTHER PUBLICATIONS

Clearsnap Holding, Inc., "Stack-A-Pad" Child Safe Ink Pads, 1992, 1 page.

Clearsnap Holding, Inc., "My First Color Box" Child Safe Ink Stack-A-Pad, 1992, 1 page.

* cited by examiner

STACKABLE CONTAINER SYSTEMS AND METHODS

RELATED APPLICATIONS

This application, U.S. patent application Ser. No. 13/764,616, filed Feb. 11, 2013, is a continuation of U.S. patent application Ser. No. 13/252,906, filed Oct. 4, 2011 now abandoned.

U.S. patent application Ser. No. 13/252,906 is a continuation of U.S. patent application Ser. No. 12/229,995, filed Aug. 27, 2008, now U.S. Pat. No. 8,028,622, which issued Oct. 4, 2011.

U.S. patent application Ser. No. 12/229,995 claims priority of U.S. Provisional Patent Application Ser. No. 61/069,209 filed Mar. 12, 2008.

The contents of all related applications listed above are incorporated herein by reference.

TECHNICAL FIELD

The present invention relates to stacking containers for products and, in particular, to containers that are adapted to be attached to one or more of similar containers, a lid, and a handle.

BACKGROUND

To save space and facilitate transportation, containers for certain products may be configured to stack one on top of another. If the product is susceptible to drying out, the containers may be configured to engage each other to define a product cavity that is at least partly airtight.

The present invention is of particular significance in the context of containers for ink pads that store ink, and that application of the present invention will be described herein in detail. However, the present invention has broader application to products other than ink pads, and the scope of the present invention should be determined by the claims appended hereto and not the following detailed description of the invention.

Ink pads are typically compressible, absorbent members impregnated with ink. Bringing an ink pad into contact with a destination surface and applying slight pressure causes ink to be transferred from the ink pad to the destination surface. The destination surface may be a sheet of material on which an image is directly formed or may be an ink stamp or the like that transfers the ink to the sheet of material on which an image is to be formed.

Ink pads are typically mounted on a base member to facilitate handling of the ink pad. The base typically comprises a substantially planar mounting surface to which the ink pad is adhered. In many cases, a cover member is detachably attached to the base member to form a container assembly defining a product cavity sized and dimensioned to surround the ink pad on the base member. When attached to the base member, the cover member inhibits movement of air between the product cavity and the surrounding environment. When the cover member is removed from the base member, the base member can be gripped to facilitate manipulation of the ink pad.

It has long been recognized that the stacking of container assemblies can be useful. For example, as mentioned above, ink pads store ink; when the ink is used to form an image, it is often desirable to use a plurality (two or more) of colors of ink. Stacking container assemblies facilitate the packaging, marketing, storing, and use of a plurality of ink pads, where each of the plurality of container assemblies contains a different color or combination of colors of ink.

A conventional container assembly can be configured such that the cover member of one container assembly engages the base member of another container assembly. A plurality of such container assemblies may be attached together to form a stack. This type of container stack will be referred to as a base/cover stack.

In a base/cover stack, the cover members of all container assemblies (the connected container assemblies) except for one (the exposed container assembly) are connected to the base member of an adjacent container assembly. The cover member of the exposed container assembly is not connected to an adjacent container assembly.

To use the ink pad contained by the exposed container assembly in a base/cover stack, the cover member is simply removed from the base member. The ink pad may then be used in a conventional manner. To use a selected one of the connected container assemblies, the container assembly or assemblies connected to the cover member of the selected container assembly is/are removed. The selected container assembly is now an exposed container assembly. The cover member of the selected container assembly may then be removed from the base member of the selected container assembly, and the ink pad contained therein may be used in a conventional manner.

With its cover member removed, any exposed container assembly may remain connected to at least one other container assembly of the base/cover stack during use, in which case any connected container assembly or assemblies in the stack can be gripped as a handle. Alternatively, the selected container assembly may be detached from the stack and used in a conventional manner. In any case, a base/cover stack can be reconfigured with any container assembly forming the exposed container assembly. Further, any one or more of the container assemblies in the stack can be removed from one end of the stack and attached to the opposite end of the stack.

To reduce the packaging materials used to form a stack of ink pad containers, the base members can be configured to engage either each other or a cover member. This type of container stack will be referred to as a base/base stack. In a base/base stack, the base members of all container assemblies (the connected container assemblies) except for one (the exposed container assembly) are connected to the base member of an adjacent container assembly. The base member of the exposed container assembly is connected to a cover member. A base/base stack thus can be configured to use only a single cover member.

To use the ink pad contained by the exposed container assembly in a base/base stack, the cover member is simply removed from the base member. The ink pad may then be used in a conventional manner. To use a selected one of the intermediate container assemblies, the container assembly or assemblies connected to the selected container assembly is/are removed. The ink pad of the selected container assembly is now exposed and can be used conventionally.

With the cover member removed, any exposed container assembly may remain connected to at least one other container assembly of the base/cover stack during use, in which case any connected container assembly or assemblies in the stack can be gripped as a handle. Alternatively, the selected container assembly may be detached from the stack and used in a conventional manner. In any case, a base/base stack can be reconfigured with any base member of the stack being considered the exposed container assembly, in which case the cover member forms a part of that exposed container assembly. As with a base/cover stack, any one or more of the container assemblies in a base/base stack can be removed from one end of the stack and attached to the opposite end of the stack.

When a container assembly is used to contain an ink pad, a stylus member can be detachably attached to a base member to facilitate manipulation of the ink pad attached to that base member.

The present invention relates to improved container assemblies that can be combined to form a base/cover stack or a base/stack, with or without a stylus member.

SUMMARY

The present invention may be embodied as A container system for containing a plurality of ink pads including a cover and a plurality of bases. The cover defines a cover mounting portion. Each base defines a support surface, a first base mounting portion, and a second base mounting portion. Each of the support surfaces is adapted to support at least one of the ink pads. The cover mounting portion is capable of engaging any one of the first base mounting portions to detachably attach the cover to the plurality of bases. The first base mounting portions are capable of engaging the second base mounting portions to detachably attach at least one of the bases to at least another of the bases. The container system operates in a stack mode and in a single mode. In the stack mode, the cover is detachably attached to one of the plurality of bases, and the one of the plurality of bases to which the cover is detachably attached is detachably attached to another of the plurality of bases. In the single mode, the cover is detachably attached to one of the plurality of bases and the plurality of bases are detached from each other.

The present invention may also be embodied as a method of containing a plurality of ink pads comprising the following steps. A cover defining a cover mounting portion is provided. A plurality of bases are provided, where each base defines a support surface, a first base mounting portion, and a second base mounting portion. The cover mounting portion is configured such that the cover mounting projection is capable of engaging the first base mounting portions to detachably attach the cover to one of the plurality of bases. The first base mounting portions are configured such that the first base mounting portions are capable of engaging the second base mounting portions to detachably attach at least one of the bases to at least another of the bases. At least one of the ink pads is supported on each of the support surfaces. The container system is operated in a stack mode by detachably attaching the cover to a first one of the plurality of bases to define the cover chamber, where the at least one ink pad supported by the support surface defined by the first one of the plurality of bases is contained within the cover chamber, and detachably attaching the first one of the plurality of bases to a second one of the plurality of bases to define a first base chamber, where the at least one ink pad supported by the support surface defined by the second one of the plurality of bases is contained within the first base chamber. The container system is operated in a single mode in which the cover is detachably attached to one of the plurality of bases and the plurality of bases are detached from each other.

DETAILED DESCRIPTION OF EXAMPLES OF THE INVENTION

Figure 1:
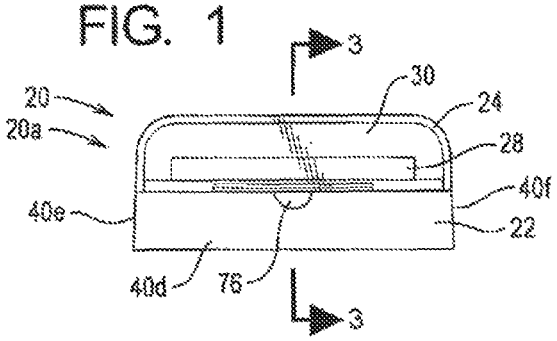
FIG. 1 is a side elevation view of a first example container assembly of the present invention.

Referring initially to FIGS. 1-11, depicted therein is a container system 20 comprising at least one base 22, a cover 24, and a stylus 26. The example container system 20 is adapted to facilitate the storage and use of an ink pad 28. The example container system 20 operates in a single mode 20*a* (FIGS. 1-5), a stack mode 20*b* (FIGS. 6 and 7), and/or a stylus mode 20*c* (FIGS. 8-11).

In the single mode 20*a*, the container system 20 comprises a single base 22 and a cover 24. The cover 24 is detachably attached to the base 22 to define a cover chamber 30 when the container system 20 is in the single mode 20*a*. The container system 20 facilitates storage of a single ink pad 28 in the single mode 20*a*. Detaching the cover 24 from the base 22 allows the ink pad 28 to be used in a conventional manner.

In the stack mode 20*b*, the container system 20 comprises a plurality (two or more) of bases 22 and a cover 24. As with the single mode 20*a*, the cover 24 is detachably attached to the base 22 to define a cover chamber 30 when the container system 20 is in the stack mode 20*b*. In addition, at least one of the plurality of bases 22 is detachably attached to at least one other of the plurality bases 22 to define at least one base chamber 32. The container system 20 facilitates the storage of a plurality of ink pads 28 in the stack mode 20*b*. Detaching the cover 24 from one of the bases 22 or any of the bases 22 from bases 22 adjacent thereto allows any of the ink pads 28 attached to the bases 22 to be used in a conventional manner.

In the stylus mode 20*c*, the container system 20 comprises one or more bases 22 and the stylus 26. In the stylus mode 20*c*, the stylus 26 is detachably attached to a single base 22 or a plurality of bases 22 to allow the ink pad 28 attached to one of the bases to be used in a conventional manner. Accordingly, the container system 20 facilitates the use of one or more ink pads 28 when configured in the stylus mode 20*c*.

Given the foregoing, the details of construction and operation of the example container system 20 will now be described in further detail.

The base 22 comprises a support wall 40, a first wall 42, and a second wall 44. The example support wall 40 is substantially planar and defines a support surface 40*a* and an interior surface 40*b*. In particular, the first and second walls 42 and 44 extend in opposite directions along the perimeter of the support wall 40.

The first wall 42 and the support surface 40*a* define a support cavity 46. The support cavity 46 is relatively shallow in a depth dimension to receive the ink pad 28 such that an inking surface 28*a* of the ink pad 28 extends beyond the first wall 42. However, the example ink pad 28 is slightly smaller than the base 22 in lateral dimensions so that the ink pad 28 may be adhered to the support surface 40*a* substantially within the support cavity 46. The second wall 44 and the interior surface 40*b* define an interior cavity 48. The dimensions of the interior cavity 48 are determined as will be described in further detail below.

Figure 2:
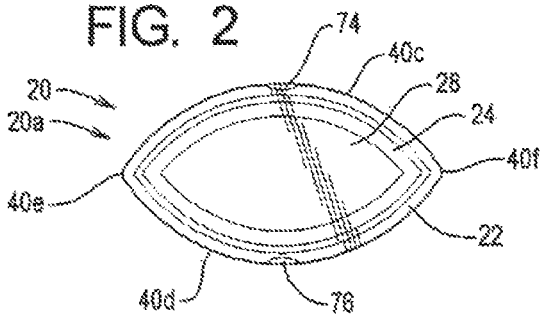
FIG. 2 is a top plan view of the first example container assembly.

As shown in FIG. 2, the example base 22 defines a pointed oval shape having one or both of functional and aesthetic features. In particular, the edge of the support wall 40 comprises two curved portions 40*c* and 40*d* that intersect at first and second point portions 40*e* and 40*f*.

In some situations, the points 40*e* and 40*f* facilitate the application of a small amount of ink to a small target surface using the inking surface 28*a*. In other situations, the entire inking surface 28*a* may be brought into contact with a target surface in a conventional manner to transfer a relatively large amount of ink to a larger target surface. While the pointed oval shape of the example base 22 is functionally and aesthetically desirable, other shapes having a different desired combination of functional and aesthetic features may be used instead of a pointed oval.

Figure 3:
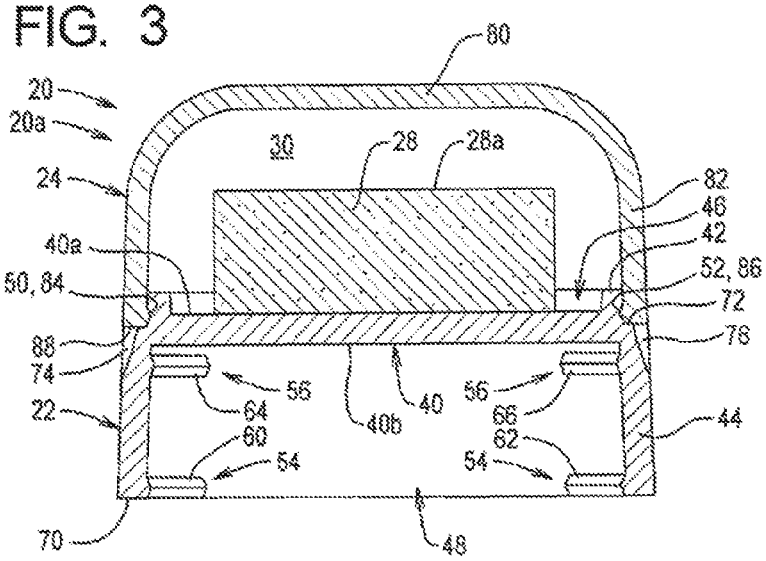
FIG. 3 is a section view of the first example container assembly taken along lines 3-3 in FIG. 1.
Figure 4:
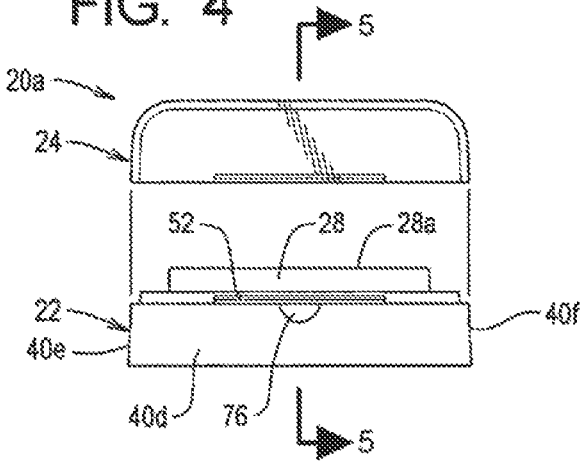
FIG. 4 is a side elevation view illustrating a cover member of the first example container assembly removed from a base member thereof.
Figure 5:
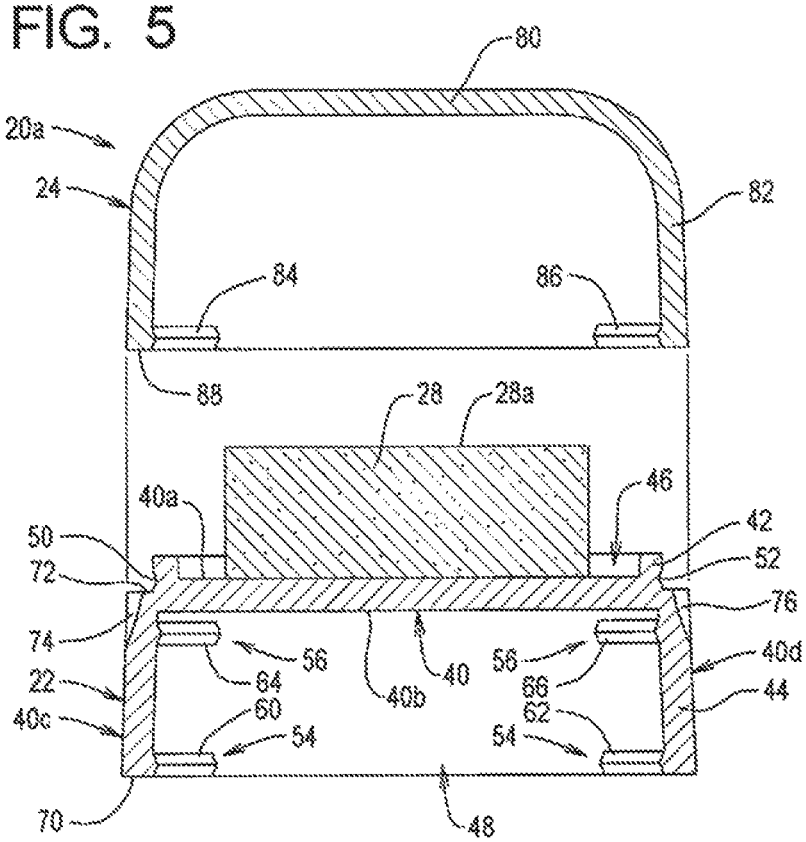
FIG. 5 is a section view of the first example container assembly illustrating a cover member of the first example container assembly removed from a base member thereof.
Figure 6:
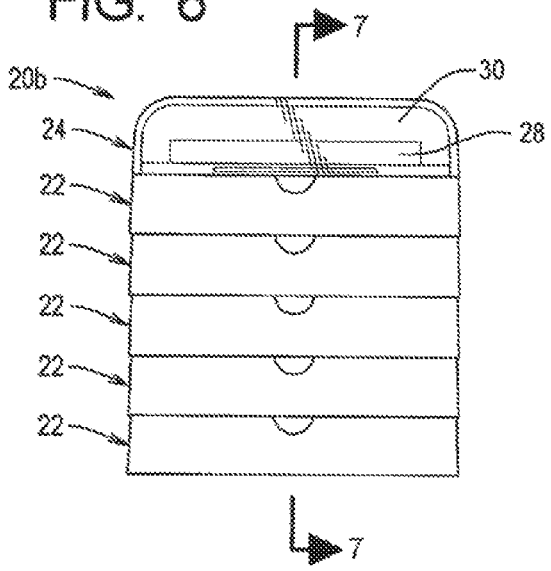
FIG. 6 is a side elevation view of a stack formed by the first example container assembly.
Figure 7:
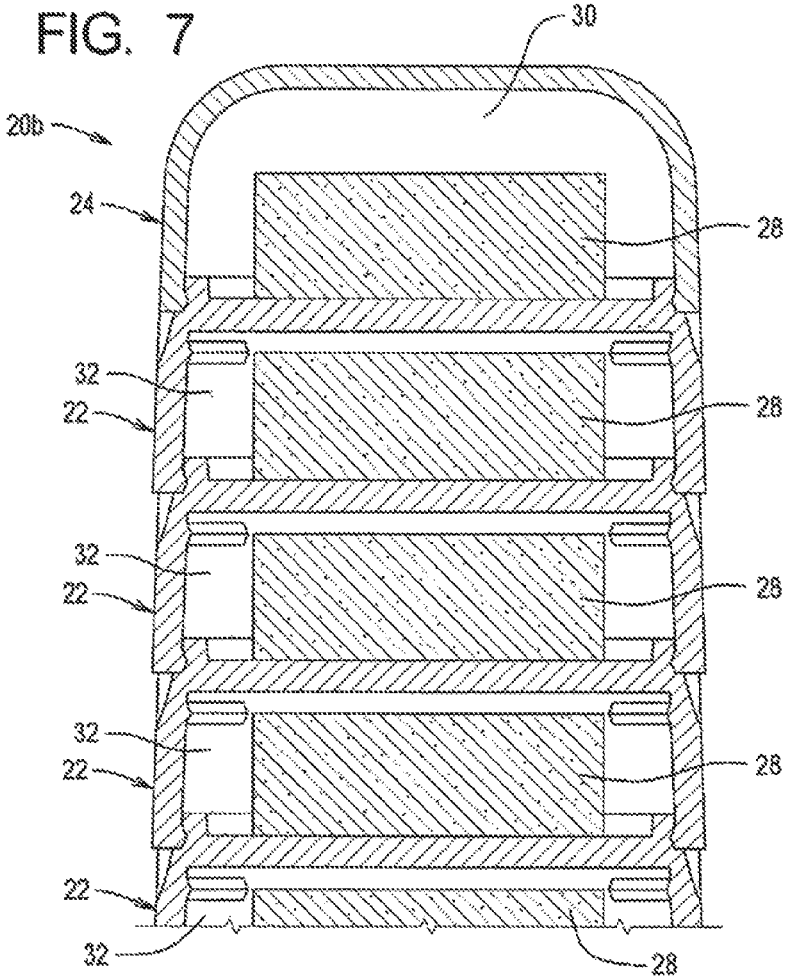
FIG. 7 is a section view of a stack formed by the first example container assembly.
Figure 8:
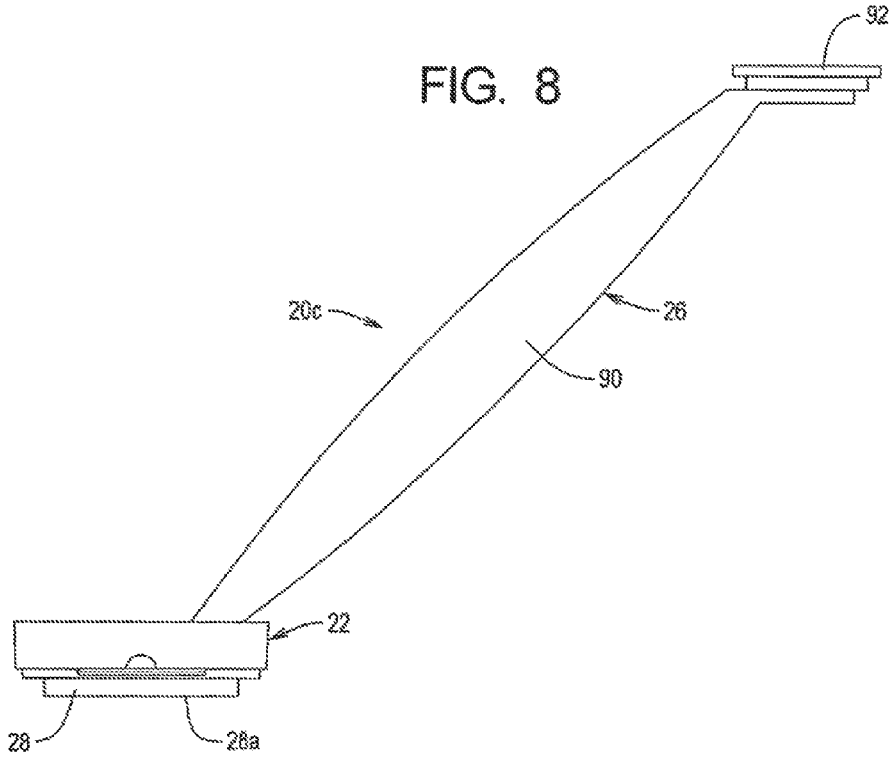
FIG. 8 is a side elevation view illustrating the connection between an example stylus member and the base member of the first example container assembly.
Figure 9:
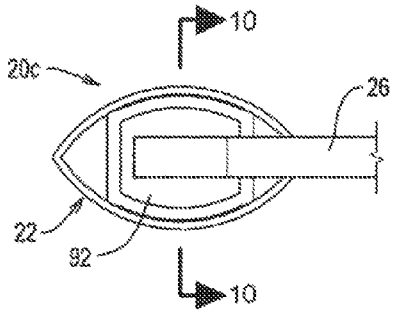
FIG. 9 is a top plan view illustrating the connection between the example stylus member and the base member of the first example container assembly.
Figure 10:
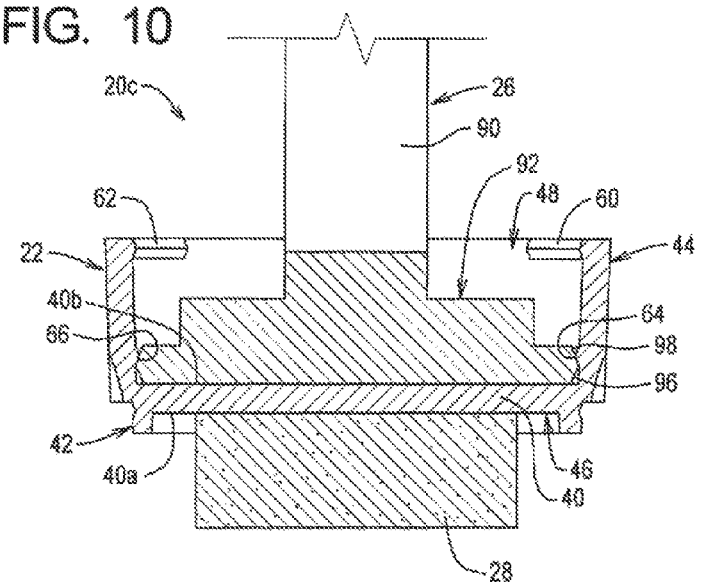
FIG. 10 is a section view illustrating the connection between the example stylus member and the base member of the first example container assembly.
Figure 11:
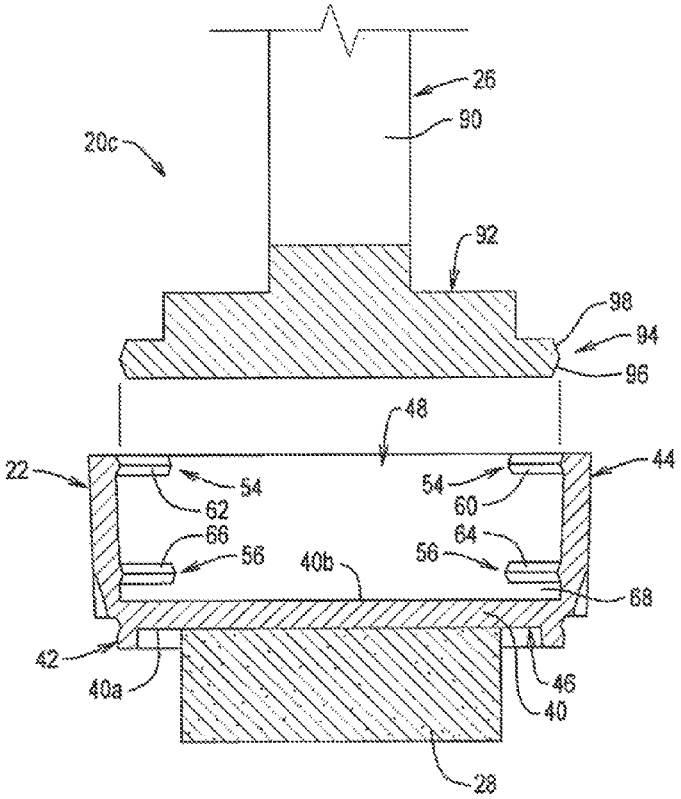
FIG. 11 is a section view illustrating that the example stylus member may be detached from the base member of the first example container assembly.

As perhaps best shown in FIGS. 3 and 5, first and second mounting notches 50 and 52 are formed in the base 22. In the example base 22, the notches 50 and 52 are formed at the juncture of the support surface 40 and the first surface 42. The notches 50 and 52 extend along part of the curved portions 40*c* and 40*d*, but terminate adjacent to the point portions 40*e* and 40*f* as perhaps best shown in FIG. 4.

FIGS. 3 and 5 further illustrate that first and second sets 54 and 56 of mounting projections extend from the second wall 44 into the interior cavity 48. In particular, the first set 54 comprises first and second mounting projections 60 and 62, while the second set 56 comprises third and fourth mounting projections 64 and 66. The example first and second mounting projections are located adjacent to a distal edge 70 of the base 22. The third and fourth mounting projections 64 and 66 are adjacent to but spaced from the support wall interior surface 40*b*. A lock portion 68 of the interior cavity 48 is formed between the projections 64 and 66 and the interior surface 40*b* of the support wall 40.

As perhaps best shown in FIGS. 2, 3, and 5, the example base 22 further comprises a stop surface 72 and first and second access notches 74 and 76. The example stop surface 72 extends around the perimeter of the first wall 42. The example access notches 74 and 76 are formed along edges of the support wall 40 adjacent to the first wall 42.

Turning now to FIGS. 3 and 5, the cover 24 will be described in further detail. The example cover 24 comprises a top wall 80 and a side wall 82. Fifth and sixth mounting projections 84 and 86 extend inwardly from the side wall 82. The side wall 82 terminates in an edge 88. The cover side wall 82 is sized and dimensioned such that the top wall 80 is spaced from the side wall edge 88 and the side wall edge 88 is substantially the same shape as the stop surface 72 of the base 22.

Turning now to FIGS. 8-11, the stylus 26 will now be described in further detail. The stylus 26 comprises a handle portion 90 and at least one mounting portion 92. For convenience, the example stylus 26 optionally comprises two such mounting portions 92.

Each mounting portion 92 comprises a mounting edge 94 defined by a first surface 96 and a second surface 98. The mounting edge 94 corresponds at least in part to the shape of the example base 22. In particular, the mounting edge 94 is sized and dimensioned to fit within the interior cavity 48 defined by the second wall 44. The example mounting edge 94 corresponds only partly to the shape of the base 22, being in the shape of an oval with the ends cut off.

The mounting notches 50 and 52 and various mounting projections 60, 62, 64, 66, 84, and 86 have a generally similar cross-sectional area. The mounting notches 50 and 52 can thus receive the projections 60 and 62 as shown in FIG. 3 (single mode) and the projections 84 and 86 as shown in FIG. 5 (stack mode) to form an interference fit between the base member 22 and another base member 22 and/or the cover member 24 to positively lock these components together.

Additionally, the mounting edge 94 can be displaced beyond the mounting projections 64 and 66 into a locking position in which the projections 64 and 66 interfere with the mounting edge 94 to form an interference fit between the base member 22 and the stylus 26 that positively locks these components together.

In particular, the first edge 96 is slanted to facilitate the pressing of the mounting portion 90 beyond the mounting projections 64 and 66 and into the locking portion 68 of the interior cavity 48. Although the mounting projections 64 and 66 interfere with movement of the mounting edge 94 to prevent the mounting portion 90 from being inadvertently withdrawn from the cavity locking portion 68, the mounting portion 90 can be removed from the locking portion 68 by the deliberate application of manual force on the stylus 26 away from the base member 22. The second slanted surfaces 98 facilitate the removal of the mounting portion 90 from the locking portion 68.

Referring now to FIGS. 12-16, depicted therein is a container system 120 comprising at least one base 122 and a cover 124. Although not shown, a stylus can be configured to work with the container system 120 as generally described above. The example container system 120 is adapted to facilitate the storage and use of an ink pad 126. The example container system 120 operates in a single mode 120*a* (FIGS. 12 and 13), a first stack mode 120*b* (FIG. 14), a second stack mode 120*c* (FIG. 15), and/or a stylus mode (not shown).

In the single mode 120*a*, the container system 120 comprises a single base 122 and a cover 124. The cover 124 is detachably attached to the base 122 to define a cover chamber 130 when the container system 120 is in the single mode 120*a*. The container system 120 facilitates storage of a single ink pad 126 in the single mode 120*a*. Detaching the cover 124 from the base 122 allows the ink pad 126 to be used in a conventional manner.

In the first stack mode 120*b*, the container system 120 comprises a plurality of bases 122 and a plurality of covers 124. Each cover 124 is detachably attached to one of the base 122 to define at least one interior chamber 132. In addition, at least one of the plurality of bases 122 is detachably attached to at least one cover members to define at least one outer chamber 134. Detaching the cover 124 from one of the bases 122 or any of the bases 122 from one of the other bases 122 allows any of the ink pads 126 attached to the bases 122 to be used in a conventional manner.

In the second stack mode 120*c*, the container system 120 comprises a plurality (two or more) of bases 122 and a cover 124. As with the single mode 120, the cover 124 is detachably attached to the base 122 to define a cover chamber 130 when the container system 120 is in the second stack mode 120*c*. In addition, at least one of the plurality of bases 122 is detachably attached to at least one other of the plurality bases 122 to define at least one base chamber 136. Detaching the cover 124 from one of the bases 122 or any of the bases 122 from bases 122 adjacent thereto allows any of the ink pads 126 attached to the bases 122 to be used in a conventional manner.

In the stylus mode, a stylus is detachably attached to a single base 122 or a plurality of bases 122 to allow the ink pad 126 attached to one of the bases to be used in a conventional manner. Accordingly, the container system 120 facilitates the use of one or more ink pads 126 when configured in the stylus mode.

Given the foregoing, the details of construction and operation of the second example container system 120 will now be described in further detail.

Figure 16:
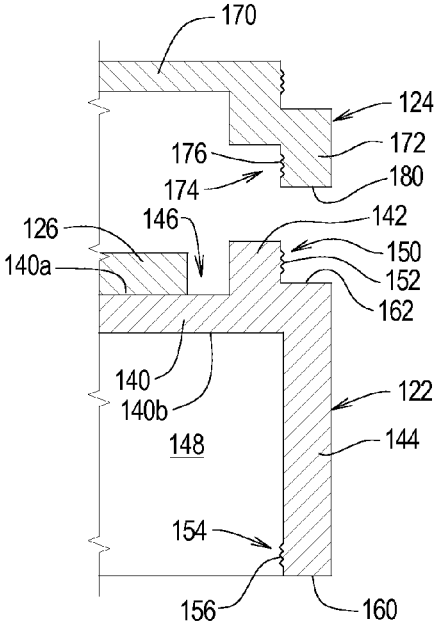
FIG. 16 is a detail of the base and cover members of the second example container assembly in the single mode.

As perhaps best shown in FIG. 16, each base 122 comprises a support wall 140, a first wall 142, and a second wall 144. The example support wall 140 is substantially planar and defines a support surface 140*a* and an interior surface 140*b*. In particular, the first and second walls 142 and 144 extend in opposite directions along the perimeter of the support wall 140.

Figure 12:
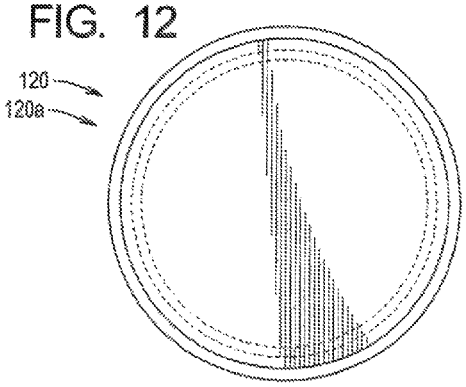
FIG. 12 is a top plan view of a second example container assembly of the present invention.

The first wall 142 and the support surface 140*a* define a support cavity 146. The support cavity 146 is relatively shallow in a depth dimension to receive the ink pad 126 such that an inking surface 126*a* of the ink pad 126 extends beyond the first wall 142. However, the example ink pad 126 is slightly smaller than the base 122 in lateral dimensions so that the ink pad 126 may be adhered to the support surface 140*a* substantially within the support cavity 146. The second wall 144 and the interior surface 140*b* define an interior cavity 148. As shown in FIG. 12, the example base 122 defines a round shape having one or both of functional and aesthetic features and at least may be used in a conventional manner to apply ink to a target surface (not shown).

Figure 17:
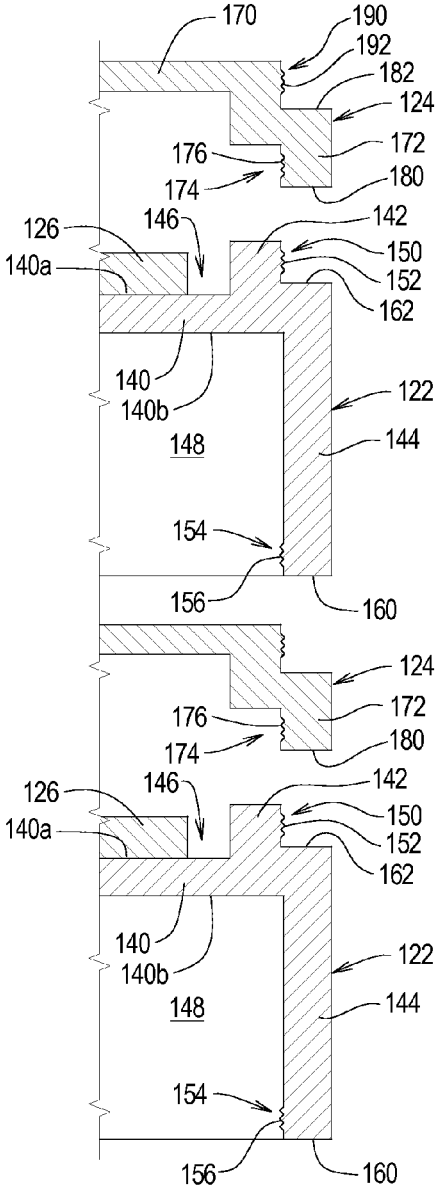
FIG. 17 is a detail of the base and cover members of the second example container assembly in a stack mode.

As perhaps best shown in FIGS. 16 and 17, a first set 150 of mounting projections 152 are formed in the base 122. In the example base 122, the projections 152 are formed in the first wall 142. FIG. 16 further illustrates that a second set 154 of mounting projections 156 extend from the second wall 144 into the interior cavity 148. The example second set 154 of mounting projections 156 is located adjacent to a distal edge 160 of the base 122. As perhaps best shown in FIGS. 16 and 17, the example base 122 further comprises a stop surface 162 that extends around the perimeter of the first wall 142.

Figure 13:
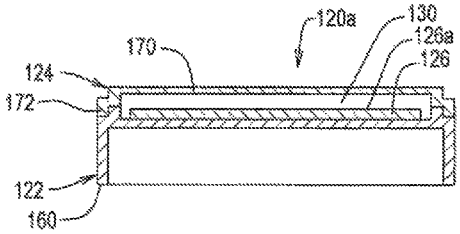
FIG. 13 is a section view of the second example container assembly of the present invention.
Figure 14:
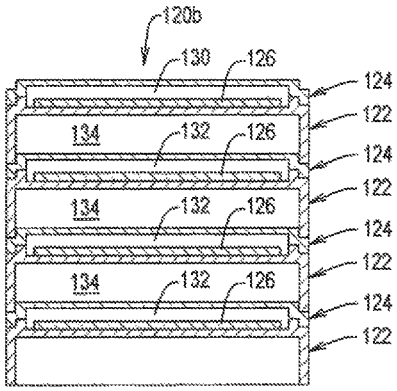
FIG. 14 is a section view of the second example container assembly configured as a base/cover stack.
Figure 15:
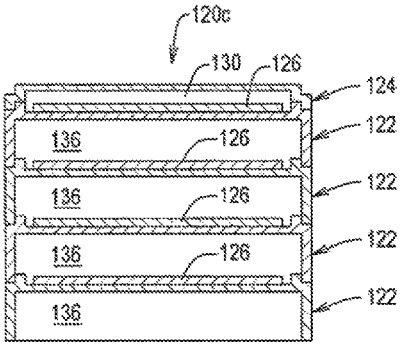
FIG. 15 is a section view of the second example container assembly configured as a base/base stack.

Turning now to FIGS. 13, 16, and 17, the cover 124 will be described in further detail. The example cover 124 comprises a top wall 170 and a side wall 172. As shown in FIG. 16, a third set 174 of mounting projections 176 extends inwardly from the side wall 172. The side wall 172 further defines a distal edge 180 and a stop surface 182. A fourth set 190 of projections 192 extend outwardly from the side wall 172 above the stop surface 182.

The sets 150 and 190 of outwardly facing projections 152 and 192 and sets 154 and 174 of inwardly facing projections 156 and 176 are formed on complementary surfaces such that any set 150 and 190 can engage any set 154 and 174. Further, the mounting projections 152, 156, 176, and 192 have a complementary cross-sectional area. The sets 150, 154, 174, and 190 of mounting projections thus allow each base 122 to be connected above and below to another base 122, above and below to one of the covers 124, or above to a cover and below to a base 122. The sets 150, 154, and 174 of mounting projections 152, 156, and 176 thus engage each other to form a connecting system that allows the container system 120 to be configured in the single mode 120*a*, first stack mode 120*b*, and/or second stack mode 120*c*.

In any of these modes 120*a*, 120*b*, and 120*c*, the projections 152 of the first set 150 or fourth set 190 can be arranged in a lock configuration in which the projections 152 or 192 are spaced alternately between the projections 156 or 176 of the second or third sets 154 or 174.

From the foregoing, it should be apparent that the present invention may be embodied in many different combinations and sub-combinations of the elements and steps described above. The scope of the present invention should thus be determined by the following claims and not the foregoing detailed description.

What is claimed is:

1. A container system for containing a plurality of ink pads, comprising:

a cover defining at least one cover point portion, and first and second cover mounting projections formed on the cover on opposite sides of the at least one cover point portion; and a plurality of bases, where each base defines at least one base point portion, a support wall defining a support surface, a first wall extending in a first direction from the support wall, a second wall extending in a second direction from the support wall, first and second base mounting notches, where the first and second base mounting notches are formed in the first wall on opposite sides of the at least one base point portion, and first and second base mounting projections extending from the second wall on opposite sides of the at least one base point portion; whereby each of the support surfaces is adapted to support at least one of the ink pads;

the cover allows the first and second cover mounting projections to enter the first and second base mounting notches, respectively, to form an interference fit that detachably attaches the cover to the plurality of bases;

the second wall allows the first and second base mounting projections to enter the first and second base mounting notches to form an interference fit that detachably attaches at least one of the bases to at least another of the bases.

2. A container system as recited in claim 1, in which at least one of the bases is detachably attached to a plurality of the plurality of the bases.

3. A container system as recited in claim 1, further comprising a stylus member defining first and second stylus engaging portions, wherein:

each base further defines third and fourth base mounting projections formed in the wall portions on opposite sides of the at least one base point portion;

the first and second stylus engaging portions are capable of engaging the third and fourth base mounting projections of one of the plurality of bases to define a stylus assembly; and the container system further operates in a stylus mode in which a selected one of the bases is detachably attached from the cover, and the stylus engaging portion is detachably attached to the third base mounting portion of the selected base to form the stylus assembly.

4. A container system as recited in claim 1, in which the cover defines a cover edge, where each of the first and second cover mounting projections portion extends at most partly around the cover edge.

5. A container system as recited in claim 1, in which each of the first and second base mounting notches each extends at most partly around the support surface.

6. A container system as recited in claim 1, in which each base defines a base edge, where the first and second base mounting projections extend at most partly around the base edge.

7. A container system as recited in claim 1, in which:

each of the first and second cover mounting projections and each of the first and second base mounting projections defines a first set of physical dimensions;

each of the first and second base mounting notches defines a second set of physical dimensions;

the first and second sets of physical dimensions are complementary.

8. A method of containing a plurality of ink pads, comprising the steps of:

providing a cover defining at least one cover point portion;

forming first and second cover mounting projections on the cover on opposite sides of the at least one cover point portion; and providing a plurality of bases, where each base defines at least one base point portion, a support surface, a first wall extending in a first direction from the support surface, and a second wall extending in a second direction from the support surface, first and second base mounting notches formed in the first wall on opposite sides of the at least one base point portion, and first and second base mounting projections formed in the second wall on opposite sides of the at least one base point portion;

supporting at least one of the ink pads on each of the support surfaces;

engaging the first and second cover mounting projections with the first and second base mounting notches to form an interference fit that detachably attaches the cover to one of the plurality of bases;

engaging the first and second base mounting projections with the second base mounting portions to form an interference fit that detachably attaches at least one of the bases to at least another of the bases.

9. A method as recited in claim 8, further comprising the step of detachably attaching the second one of the plurality of bases to a third one of the plurality of bases.

10. A method as recited in claim 8, further comprising the step of providing a stylus member defining a first and second stylus engaging portions, in which:

the base further defines third and fourth base mounting projections formed on opposite sides of the at least one base point portion;

the first and second stylus engaging portions are capable of engaging the third and fourth base mounting projections of one of the plurality of bases to define a stylus assembly; and further comprising the step of operating the container system in a stylus mode by detaching the cover from the plurality of bases, detaching the first and second bases from each other, and forming the stylus assembly by detachably attaching the stylus engaging portion to the third base mounting portion of one of the plurality of bases.

* * * * *